US008869772B2

(12) United States Patent
Hisaminato et al.

(10) Patent No.: US 8,869,772 B2
(45) Date of Patent: Oct. 28, 2014

(54) ENGINE CONTROL APPARATUS

(75) Inventors: Naoto Hisaminato, Susono (JP); Manabu Tateno, Sunto-gun (JP); Eiichi Kamiyama, Susono (JP)

(73) Assignee: Toyota Jidosha Kabushiki Kaisha, Achi-ken (JP)

( * ) Notice: Subject to any disclaimer, the term of this patent is extended or adjusted under 35 U.S.C. 154(b) by 59 days.

(21) Appl. No.: 13/882,439

(22) PCT Filed: Apr. 15, 2011

(86) PCT No.: PCT/JP2011/059424

§ 371 (c)(1),
(2), (4) Date: Apr. 29, 2013

(87) PCT Pub. No.: WO2012/140779

PCT Pub. Date: Oct. 18, 2012

(65) Prior Publication Data

US 2013/0220272 A1 Aug. 29, 2013

(51) Int. Cl.

| | |
|---|---|
| ***F01L 13/06*** | (2006.01) |
| ***F02D 13/02*** | (2006.01) |
| ***F02D 15/04*** | (2006.01) |
| ***F02D 13/04*** | (2006.01) |
| ***F02B 75/04*** | (2006.01) |
| ***F01L 1/34*** | (2006.01) |
| *F01L 1/047* | (2006.01) |

(52) U.S. Cl.

CPC ..... *F01L 13/065* (2013.01); *F01L 2800/06* (2013.01); *F02D 13/0257* (2013.01); *F02D 13/0238* (2013.01); *F02D 15/04* (2013.01); *F02D 13/04* (2013.01); *F01L 13/06* (2013.01); *F02B 75/041* (2013.01); *F01L 2001/0473* (2013.01); *F01L 1/34* (2013.01)

USPC ..... 123/321

(58) Field of Classification Search

CPC .. F01L 13/06; F01L 2800/06; F01D 13/0257; F01D 13/04; F01D 13/0238

USPC ..... 123/90.15, 90.16, 320–325; 701/110

See application file for complete search history.

(56) References Cited

U.S. PATENT DOCUMENTS

| | | | | |
|---|---|---|---|---|
| 6,192,857 | B1 * | 2/2001 | Shimada | 123/322 |
| 7,011,056 | B2 * | 3/2006 | Melchior | 123/90.16 |
| 7,201,140 | B2 * | 4/2007 | Megli et al. | 123/322 |
| 7,287,513 | B2 * | 10/2007 | Morin | 123/432 |
| 7,367,921 | B2 * | 5/2008 | Lewis | 477/111 |
| 7,484,483 | B2 * | 2/2009 | Yang et al. | 123/90.15 |
| 7,555,998 | B2 * | 7/2009 | Yang et al. | 123/90.12 |
| 7,930,087 | B2 * | 4/2011 | Gibson et al. | 701/103 |

(Continued)

FOREIGN PATENT DOCUMENTS

| | | |
|---|---|---|
| JP | 07091265 A | 4/1995 |
| JP | 09-170462 A | 6/1997 |

(Continued)

*Primary Examiner* — Thomas Moulis
*Assistant Examiner* — Elizabeth Hadley
(74) *Attorney, Agent, or Firm* — Sughrue Mion, PLLC

(57) ABSTRACT

An ECU 70A is associated with an engine 1 provided with a VVT 30 capable of independently setting a phase of an intake valve 2A and a phase of an intake valve 2B of two intake valves 2 mounted for a combustion chamber E. The ECU 70A includes a controller control the VVT 30 based on a magnitude of engine brake required to the engine 1 to vary a phase of at least one of the intake valves 2A and 2B.

5 Claims, 15 Drawing Sheets

(56) References Cited

U.S. PATENT DOCUMENTS

| | | | | |
|---|---|---|---|---|
| 8,061,318 | B2 * | 11/2011 | Cleary et al. | 123/90.17 |
| 8,789,502 | B2 * | 7/2014 | Barnes | 123/90.16 |
| 8,798,891 | B2 * | 8/2014 | Marriott et al. | 701/101 |
| 2010/0163001 | A1 | 7/2010 | Akihisa et al. | |
| 2011/0015849 | A1 * | 1/2011 | Suzuki et al. | 701/103 |

FOREIGN PATENT DOCUMENTS

| | | | |
|---|---|---|---|
| JP | 10-184405 | A | 7/1998 |
| JP | 2000045738 | A | 2/2000 |
| JP | 2005002982 | A | 1/2005 |
| JP | 2007-239592 | A | 9/2007 |
| JP | 2008-274962 | A | 11/2008 |
| JP | 2009074366 | A | 4/2009 |
| JP | 2009108722 | A | 5/2009 |
| JP | 2009-144521 | A | 7/2009 |
| JP | 2010-077815 | A | 4/2010 |
| JP | 2010071274 | A | 4/2010 |
| JP | 2010518322 | A | 5/2010 |
| JP | 2010-196532 | A | 9/2010 |

* cited by examiner

ENGINE CONTROL APPARATUS

CROSS REFERENCE TO RELATED APPLICATIONS

This application is a National Stage of International Application No. PCT/JP2011/059424 filed Apr. 15, 2011, the contents of all of which are incorporated herein by reference in their entirety.

TECHNICAL FIELD

The present invention is related to an engine control apparatus, in particularly, to an engine control apparatus provided in an engine provided with a valve drive device capable of independently setting a phase of one intake valve and a phase of another intake valve of plural intake valves mounted for a combustion chamber.

BACKGROUND ART

There is known a valve drive device capable of independently setting a phase of one intake valve and a phase of another intake valve of plural intake valves mounted for a combustion chamber. In this regard, for example, Patent document 1 discloses a valve drive device for varying valve timings of first and second engine valves, which are the same type and which are mounted for a combustion chamber.

Also, for example, Patent Documents 2 and 3 disclose techniques which might be relevant to the present invention in an aspect of control. In an engine control apparatus disclosed in Patent Document 2, a cam phase difference is reduced by a variable phase cam control mechanism and a throttle opening degree of a throttle valve is reduced when it is determined that engine brake is needed in a vehicle state. In a control apparatus of an internal combustion engine disclosed in Patent Document 3, a closing timing of an intake valve is more retarded and an throttle opening degree is more reduced as a brake pedal operation amount is larger so as to make an intake air amount constant, when a vehicle is decelerated by operating the brake pedal.

In addition, in constitution, Patent Document 4 discloses a spark ignition internal combustion engine, as a technique relevant to the present invention, provided with: a variable compression ratio mechanism capable of varying a mechanical compression ratio; and a variable valve timing mechanism capable of independently controlling an opening timing and a closing timing of the intake valve.

PRIOR ART DOCUMENT

Patent Document

[Patent Document 1] Japanese Patent Application Publication No. 2009-144521

[Patent Document 2] Japanese Patent Application Publication No. 10-184405

[Patent Document 3] Japanese Patent Application Publication No. 2010-77815

[Patent Document 4] Japanese Patent Application Publication No. 2008-274962

SUMMARY OF THE INVENTION

Problems to be Solved by the Invention

FIG. 14 is an exemplary view of a PV diagram during the engine brake operation. FIG. 15 is a view of phases of intake valves 2A and 2B corresponding to FIG. 14. The PV diagram in FIG. 14 illustrates a counterclockwise cycle. A size of an area surrounded by PV lines indicates a size of a load acting as a negative load on an engine. The intake valves 2A and 2B are two intake valves mounted for the same combustion chamber. FIG. 15 illustrates a state where the opening timing of the intake valve 2B is set to the intake stroke start time (intake stroke top dead center) with the phase of the intake valve 2A being retarded most during the engine brake operation.

In this case, even when the intake valve 2B closes in a compression stroke, the intake valve 2A is maintained in the opening state. Thus, in this case, while the intake valve 2A is opening, gas is returned from a cylinder to an intake passage. As a result, an amount of the gas reduces and then an actual compression ratio reduces. On the other hand, even when the actual compression ratio reduces during the engine brake operation, an amount of stroke of a piston does not change in an expansion stroke. This results in the excessive expansion in this case, so that engine brake is strengthened by an area S1.

Also, in this case, there is a state where only the intake valve 2B opens early in the intake stroke. Thus, in this case, the negative pressure occurring in the cylinder increases. This results in that the pumping loss increases by an area S2. Thus, the engine brake is strengthened by the area S2. Further, when the opening timing of the intake valve 2B is set to the intake stroke start timing, the valve lift amount is zero or very small at the intake stroke start timing. For this reason, in this case, since it is difficult to introduce the intake air to the cylinder, the pumping loss increases. As a result, the engine brake is strengthened.

Thus, for example, in a case where an engine is installed in a vehicle, since the engine brake is strengthened, this might give a driver a feel of deceleration more than necessary. Also, for example, in a case where the engine is installed in a vehicle (for example, hybrid vehicle) regenerating against the kinetic energy in the engine brake operation, since the engine brake is strengthened, the efficiency of the regeneration might decrease.

The present invention has been made in view of the above circumstances and has an object to provide an engine control apparatus capable of controlling a magnitude of engine brake of an engine provided with a valve drive device capable of independently setting a phase of one intake valve and a phase of another intake valve of plural intake valves mounted for a combustion chamber.

Means for Solving the Problems

The present invention is an engine control apparatus provided in an engine provided with a valve drive device capable of independently setting a phase of one intake valve and a phase of another intake valve of plural intake valves mounted for a combustion chamber, the engine control apparatus including a controller controlling the valve drive device based on a magnitude of engine brake required to the engine to vary at least one of the phase of the one intake valve and the phase of the another intake valve.

In the present invention, the controller may at least partially advance the phase of the one intake valve to a larger extent as the magnitude of the engine brake required to the engine is smaller.

In the present invention, the controller may at least partially advance the phase of the another intake valve to a larger extent as the magnitude of the engine brake required to the engine is smaller.

In the present invention, when the magnitude of the engine brake required to the engine is smaller than a first predetermined value, the controller may advance at least one of the phase of the one intake valve and the phase of the another intake valve, as compared with when the magnitude of the engine brake required to the engine is larger than the first predetermined value.

In the present invention, when the magnitude of the engine brake required to the engine is smaller than the first predetermined value, the controller may advance the phase of the one intake valve and the phase of the another intake valve, whereby when the magnitude of the engine brake required to the engine is larger than the first predetermined value, the controller may retard the phase of the one intake valve and the phase of the another intake valve, as compared with when the magnitude of the engine brake required to the engine is smaller than the first predetermined value.

In the present invention, when the magnitude of the engine brake required to the engine is smaller than the first predetermined value, the controller may advance the phase of the one intake valve and the phase of the another intake valve, when the magnitude of the engine brake required to the engine is becoming smaller than the first predetermined value, the controller may advance the phase of the one intake valve preferentially to the phase of the another intake valve, and when there is a phase difference between the one intake valve and the another intake valve, the one intake valve may operate after the another intake valve operates.

In the present invention, when the magnitude of the engine brake required to the engine is smaller than a second predetermined value smaller than the first predetermined value, the controller may advance the phases of the one intake valve and the another intake valve, as compared with when the magnitude of the engine brake required to the engine is larger than the first predetermined value, and when the magnitude of the engine brake required to the engine is larger than the second predetermined value and smaller than the first predetermined value, the controller may advance the phase of the one intake valve of the one intake valve and the another intake valve, as compared with when the magnitude of the engine brake required to the engine is larger than the first predetermined value.

In the present invention, when the magnitude of the engine brake required to the engine is smaller than the second predetermined value, the controller may advance the phase of the one intake valve such that a phase advance amount is a first phase advance amount, when the magnitude of the engine brake required to the engine is larger than the second predetermined value and smaller than the first predetermined value, the controller may advance the phase of the one intake valve to a larger extent as the magnitude of the engine brake required to the engine is smaller and a phase advance amount to be reached may be set as the first phase advance amount, when the magnitude of the engine brake required to the engine is smaller than a third predetermined value smaller than the second predetermined value, the controller may advance the phase of the another intake valve such that a phase advance amount is a second phase advance amount, and when the magnitude of the engine brake required to the engine is larger than the third predetermined value and smaller than the second predetermined value, the controller may advance the phase of the another intake valve to a larger extent as the magnitude of the engine brake required to the engine is smaller and a phase advance amount to be reached may be set as the second phase advance amount.

In the present invention, the engine may be provided with a variable compression ratio mechanism for varying a mechanical compression ratio.

Effects of the Invention

In the present invention, it is possible to control a magnitude of engine brake of the engine provided with a valve drive device capable of independently setting a phase of one intake valve and a phase of another intake valve of plural intake valves mounted for a combustion chamber.

MODES FOR CARRYING OUT THE INVENTION

Embodiments according to the present invention will be described with reference to drawings.

First Embodiment

Figure 1:
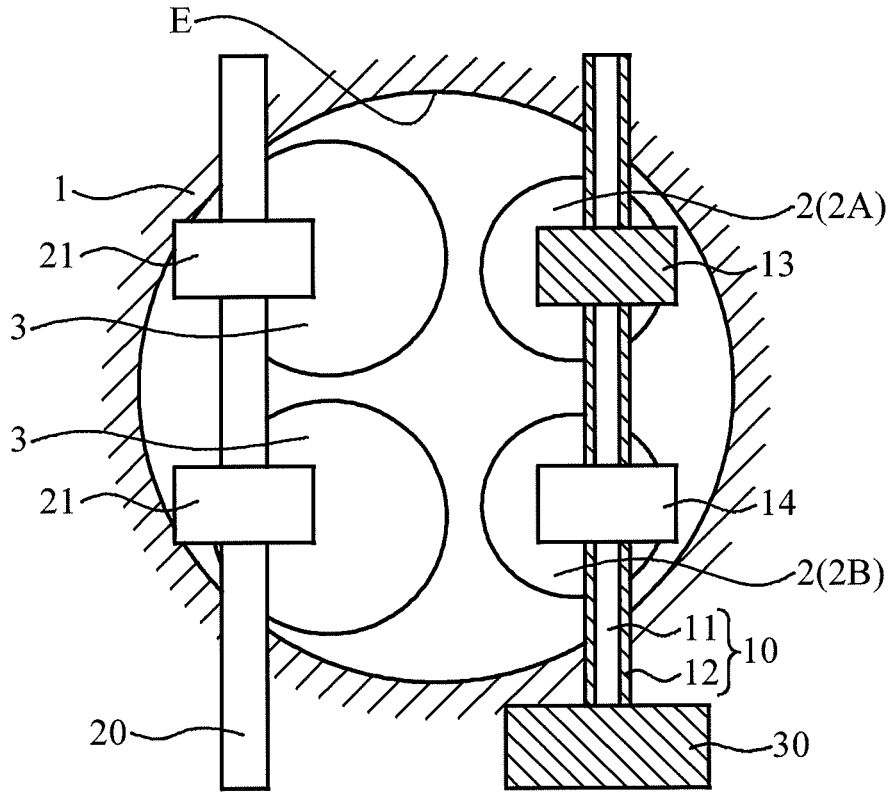
FIG. 1 is a schematic view of an engine.

FIG. 1 is a schematic view of an engine 1. The engine 1 is installed in a vehicle not illustrated. For example, the engine 1 can be installed in a hybrid vehicle regenerating the energy at the time of decelerating. The engine 1 is equipped with intake valves 2 and exhaust valves 3. Plural intake valves 2 and plural exhaust valves 3 (here, two) are mounted for a combustion chamber E. The engine 1 is provided with two intake valves 2, specifically, intake valves 2A and 2B.

The engine 1 is provided with a first camshaft 10 and a second camshaft 20. The first camshaft 10 is provided at the intake valves 2A and 2B side. The second camshaft 20 is provided at the exhaust valves 3 side. The second camshaft 20 is provided with exhaust cams 21. The exhaust cams 21 correspond to the exhaust valves 3, and drive the exhaust valves 3 respectively.

The first camshaft 10 has a dual camshaft structure, and includes an outer camshaft 11, an inner camshaft 12, an outer cam 13, and an inner cam 14. The outer camshaft 11 has a hollow structure. The inner camshaft 12 is inserted into the outer camshaft 11 to relatively rotate. The outer cam 13 is provided in the outer camshaft 11. The outer cam 13 corresponds to the intake valve 2A, and drives the intake valve 2A.

The inner cam 14 is capable of sliding over the outer camshaft 11 in a circumferential direction. The inner cam 14 is connected to the inner camshaft 12. The inner cam 14 is connected to the inner camshaft 12 by a connection pin through an oblong hole which is provided in the outer camshaft 11 and which extends in the circumferential direction. The inner cam 14 corresponds to the intake valve 2B, and drives the intake valve 2B.

The engine 1 is provided with a Variable Valve Timing (VVT) 30. The VVT 30 is a valve drive device capable of independently setting a phase of the intake valve 2A as one intake valve and a phase of the intake valve 2B as another intake valve, of two intake valves 2. For example, the valve drive device may be one disclosed in Patent Document 1. For example, the valve drive device may be provided with electromagnetic drive devices for electromagnetically driving the intake valves 2A and 2B respectively.

Specifically, the VVT 30 varies at least one of the phases of the outer camshaft 11 and the inner camshaft 12 so as to vary at least one of the phases of the intake valves 2A and 2B. In this regard, the VVT 30 varies at least one of the phases the outer camshaft 11 and the inner camshaft 12 by hydraulics so as to vary at least one of the outer camshaft 11 and the inner camshaft 12. For example, the hydraulics is supplied to the VVT 30 from a hydraulic pump driven by output of the engine 1.

Specifically, the VVT 30 wholly varies the phase of the first camshaft 10 so as to wholly vary the phases of the intake valves 2A and 2B. Also, the phase difference between the outer camshaft 11 and the inner camshaft 12 is varied, and then the phase difference between the intake valves 2A and 2B is varied. In this regard, specifically, for example, the VVT 30 can vary at least one of the intake valves 2A and 2B as follows.

That is, the phases of the intake valves 2A and 2B are wholly retarded, and the phase of the intake valve 2B is advanced relative to the phase of the intake valve 2A, thereby retarding at least the phase of the intake valve 2A of the intake valves 2A and 2B. In this case, the VVT 30 retards at least the phase of the intake valve 2A, thereby retarding the phase of the intake valve 2A relative to the phase of the intake valve 2B. In this regard, specifically, the intake valve 2A operates after the intake valve 2B operates when there is a phase difference between the intake valves 2A and 2B.

Figure 2:
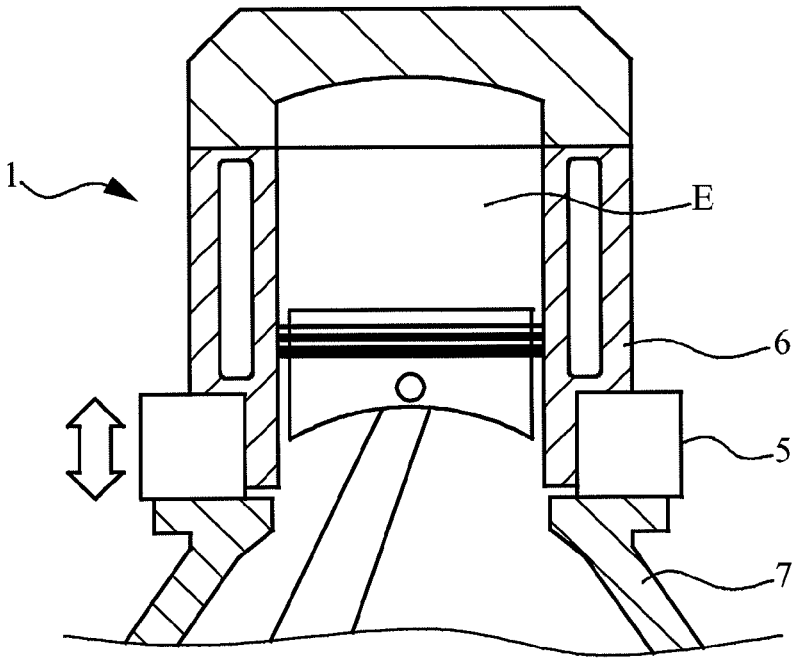
FIG. 2 is a view of a variable compression ratio mechanism.

FIG. 2 is a view of a variable compression ratio mechanism 5. The engine 1 is provided with the variable compression ratio mechanism 5 and a cylinder block 6 and a crankcase 7. The variable compression ratio mechanism 5 is provided between the cylinder block 6 and the crankcase 7. The variable compression ratio mechanism 5 moves the cylinder block 6 upward and downward relative to the crankcase 7 so as to vary the mechanical compression ratio. The variable compression ratio mechanism 5 moves the cylinder block 6 upward, so that a capacity of the combustion chamber E increases. As a result, the mechanical compression ratio decreases. On the contrary, the cylinder block 6 moves downward, so that the capacity of the combustion chamber E decreases. As a result, the mechanical compression ratio increases.

In this regard, in order to improve the fuel consumption of the engine 1, for example, the closing timing of the intake valve 2A is retarded in the idling state so as to reduce an actual compression ratio. Also, an increase in the mechanical compression ratio increases the expansion ratio. In a case where the closing timing of the intake valve 2A is retarded, the phase of the intake valve 2A can be retarded to the limit. In a case where the mechanical compression ratio increases, the mechanical compression ratio can increase to the limit mechanical compression ratio that is a limit in the structure of the combustion chamber E.

Figure 3:
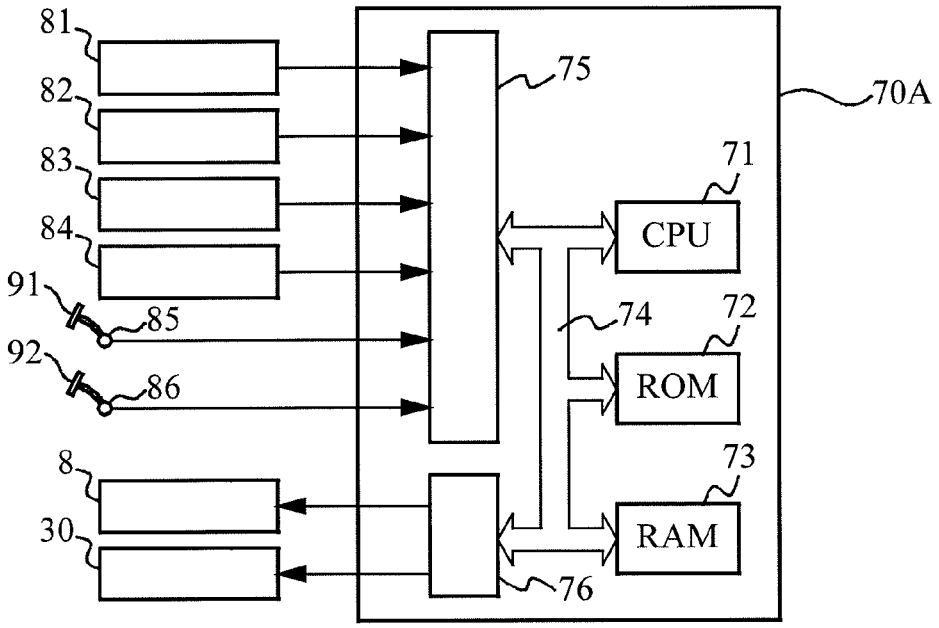
FIG. 3 is a schematic view of an ECU.

FIG. 3 is a schematic view of an ECU 70A. The ECU 70A is an electronic controller corresponding to an engine controller, and the ECU 70A is associated with the engine 1. The ECU 70A is provided with: microcomputer including a CPU 71, a ROM 72, a RAM 73, and the like; and input and output circuits 75 and 76. These components are connected to one another through a bus 74.

To the ECU 70A are electrically connected various sensors and switches such as: a crank angle sensor 81 detecting a speed of the engine 1; an airflow meter 82 measuring an amount of the intake air of the engine 1; a phase sensor 83 detecting the phase of the outer camshaft 11; a phase sensor 84 detecting the phase of the inner camshaft 12; a brake sensor 85 detecting an operation amount G of a brake pedal 91; and a accelerator opening sensor 86 detecting an operation amount G' of an accelerator pedal 92. Also, various control objects such as fuel injection valve 8 that the engine 1 is provided with or the VVT 30 are connected electrically. The phases of the intake valves 2A and 2B can be detected based on the outputs from the phase sensors 83 and 84.

The brake pedal 91 is an brake operation portion capable of braking an object driven by the engine 1. The brake pedal 91 can brake the object driven by the engine 1 to a larger extent as the operation amount G as the brake operation amount is larger. The accelerator pedal 92 is an accelerating operation portion for requiring acceleration to the engine 1. The accelerator pedal 92 can require the acceleration to the engine 1 to a larger extent as the operation amount G' as the accelerating operation amount is larger.

The ROM 72 stores map data and programs describing several processes performed by the CPU 71. The CPU 71 uses temporary storage of the RAM 73 if necessary, and performs processes, on the basis of the programs stored in the ROM 72. Therefore, the ECU 70A achieves various functions. In this point, the ECU 70A functionally achieves a controller as follows.

The controller controls the VVT 30 to vary at least one of the phases of the intake valves 2A and 2B. For example, the controller controls the VVT 30 based on an engine driving state. Also, the controller controls the VVT 30 based on a magnitude of engine brake required to the engine 1 (hereinafter referred to as requirement engine brake).

The requirement engine brake has a magnitude corresponding to a magnitude of brake required by a driver. In contrast, the magnitude of the requirement engine brake is recognized based on the operation amount G. This is because the magnitude of brake required by a driver is reflected by the operation amount G. Thus, the controller controls the VVT 30 based on the magnitude of the requirement engine brake, specifically, based on the operation amount G corresponding to the magnitude of the requirement engine brake.

When the magnitude of the requirement engine brake is smaller than a first predetermined value $\alpha$ (specifically, is equal to or smaller than the first predetermined value $\alpha$), the controller advances at least one of the phases of the intake valves 2A and 2B, as compared with when the magnitude of the requirement engine brake is larger than the first predetermined value $\alpha$. In this regard, the first predetermined value $\alpha$ may be included in a case where the magnitude of the requirement engine brake is larger than the first predetermined value $\alpha$, and the controller may control a case where the magnitude of the requirement engine brake is smaller than the first predetermined value α and a case where the magnitude of the requirement engine brake is equal or larger than the first predetermined value α.

Specifically, when the magnitude of the requirement engine brake is smaller than the first predetermined value α, the controller advances at least one of the phases of the intake valves 2A and 2B, as compared with when the phases of the intake valves 2A and 2B are not varied based on the magnitude of the requirement engine brake. Therefore, when the magnitude of the requirement engine brake is smaller than the first predetermined value α, the controller advances at least one of the phases of the intake valves 2A and 2B, as compared with when the magnitude of the requirement engine brake is larger than the first predetermined value α.

In this regard, when the acceleration is not required to the engine 1, the controller retards at least the phase of the intake valve 2A such that the phase of the intake 2A is retarded relative to the phase of the intake valve 2B. Also, when the magnitude of the requirement engine brake is larger than the first predetermined value α, the phase of the intake valve 2A continues being retarded from the time when the acceleration is not required, so that the phase of the intake 2A is retarded relative to the phase of the intake valve 2B.

In order to retard at least the phase of the intake valve 2A such that the phase of the intake valve 2A is retarded relative to the phase of the intake valve 2B, the controller, specifically, wholly retards the phases of the intake valves 2A and 2B and advances the phase of the intake valve 2B relative to the phase of the intake valve 2A. Also, the phase of the intake valve 2B is advanced relative to the phase of the intake valve 2A so as to set the opening timing of the intake valve 2B to the intake stroke start timing.

When the magnitude of the requirement engine brake is smaller than the first predetermined value α, specifically, the controller advances the phases of the intake valves 2A and 2B. Then, when the magnitude of the requirement engine brake is smaller than the first predetermined value α, the phases of the intake valves 2A and 2B are retarded, as compared with when the magnitude of the requirement engine brake is smaller than the first predetermined value α.

In order to control the VVT 30 based on the magnitude of the requirement engine brake, the controller controls the VVT 30 during the engine brake operation of the engine 1. In contrast, specifically, when the acceleration is not required (the accelerator pedal 92 is not operated) to perform fuel cut, the controller controls the VVT 30. In this regard, in the engine 1, when the acceleration is not required, the fuel cut is performed by fuel injection control the ECU 70A performs. Additionally, for example, the fuel injection control may be performed by an electronic controller except the ECU 70A.

Figure 4A:
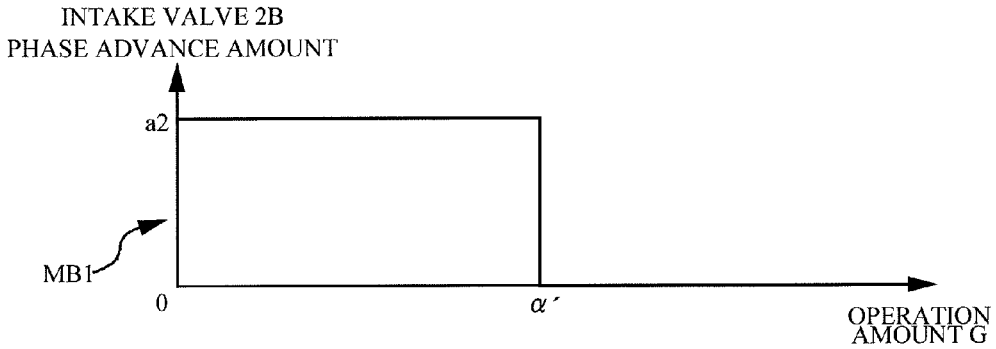
FIGS. 4A and 4B are schematic views of phase advance amount map data in a first embodiment.
Figure 4B:
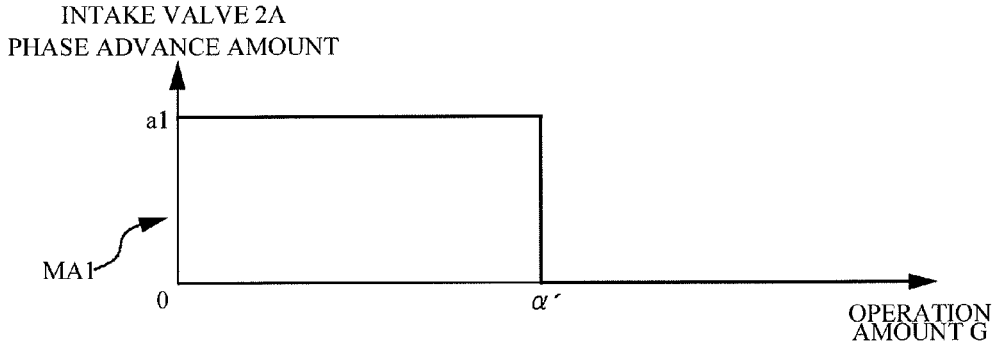

FIGS. 4A and 4B are schematic views of map data MA1 and MB1, stored in the ECU 70A, relating to phase advance amounts of the intake valves 2A and 2B. FIG. 4A illustrates the map data MB1 relating to the phase advance amount of the intake valve 2B, and FIG. 4B illustrates the map data MA1 relating to the phase advance amount of the intake valve 2A. The map data MA1 and MB1 are made, as with a reference for the phase which is varied when the magnitude of the requirement engine brake is larger than the first predetermined value α. In this regard, a first predetermined value α' corresponds to the predetermined value α in the requirement engine brake in the operation amount G.

When the operation amount G is equal to or smaller than the first predetermined value α' (thus, when the operation amount G is smaller than the first predetermined value α'), the phase advance amount of the intake valve 2B is set to a predetermined valve α2 as a second phase advance amount. When the operation amount G is equal to or smaller than the first predetermined value α' (thus, is smaller than the first predetermined value α'), the phase advance amount of the intake valve 2A is set to a predetermined valve α1 as a first phase advance amount. The predetermined values α1 and α2 may be the same. When the operation amount G is larger than the first predetermined value α', each of the phase advance amounts of the intake valves 2A and 2B is set to zero.

On the other hand, specifically, the controller detects the operation amount G, and then reads the corresponding phase advance amounts of the intake valves 2A and 2B with reference to the map data MA1 and MB1. Then, the VVT 30 is controlled such that the phase advance amounts of the intake valves 2A and 2B are set to the read phase advance amounts, thereby varying the phases of the intake valves 2A and 2B as mentioned above. In this regard, when the magnitude of the requirement engine brake is smaller than the first predetermined value α, the controller advances the phase of the intake valve 2A such that the phase advance amount is set to the predetermined value γ1. Also, the phase of the intake valve 2B is advanced such that the phase advance amount is set to the predetermined value α2.

Next, the first control operation of the ECU 70A will be described with reference to a flowchart illustrated in FIG. 5. The ECU 70A determines whether the acceleration is required (step S1). If a positive determination is made, the flowchart is temporarily finished. In contrast, if a negative determination is made, the ECU 70A retards at least the phase of the intake valve 2A such that the phase of the intake valve 2A is retarded relative to the phase of the intake valve 2B (step S2).

In step S2, specifically, the ECU 70A wholly retards the phases of the intake valves 2A and 2B, and then advances the phase of the intake valve 2B relative to the phase of the intake valve 2A. Also, the phase of the intake valve 2B is advanced relative to the phase of the intake valve 2A such that the opening timing of the intake valve 2B is set to the intake stroke start timing.

After step S2, the ECU 70A determines whether the engine brake is being operated (step S3). It can be determined whether or not the engine brake is working based on, for example, whether or not the fuel cut is performed in the engine 1 by shifting a state of requiring the acceleration to a state of not requiring the acceleration. It can be determined whether or not the fuel cut is performed in the engine 1 based on the fuel injection control performed by the ECU 70A. If a negative determination is made, this flowchart is temporarily finished. If a positive determination is made in step S3, the ECU 70A determines whether or not the operation amount G is equal to or smaller than the first predetermined value α' (step S4). Therefore, it is determined whether or not the magnitude of the requirement engine brake is smaller than the first predetermined value α.

If a positive determination is made in step S4, the ECU 70A relatively advances the phase of the intake valve 2A, as compared with when the operation amount G is larger than the first predetermined value α' (step S5). Also, the phase of the intake valve 2B is advanced, as compared with when the operation amount G is larger than the first predetermined value α' (step S6). In steps S5 and S6, specifically, the phases of the intake valves 2A and 2B can be advanced, as a reference, with the phases of the intake valves 2A and 2B being varied when the operation amount G is larger than the first predetermined value α' (that is, when the magnitude of the requirement engine brake is larger than the first predetermined value α).

If a negative determination is made in step S4, the ECU 70A relatively retards the phase of the intake valve 2A, as compared with when the operation amount G is equal to or smaller than the first predetermined value α' (step S7). Also, the phase of the intake valve 2B is relatively retarded, as compared with when the operation amount G is equal to or smaller than the first predetermined value α' (step S8). In this regard, in steps S7 and S8, specifically, the phase of the intake valve 2A at least continues being retarded from when the acceleration is not required.

Figure 5:
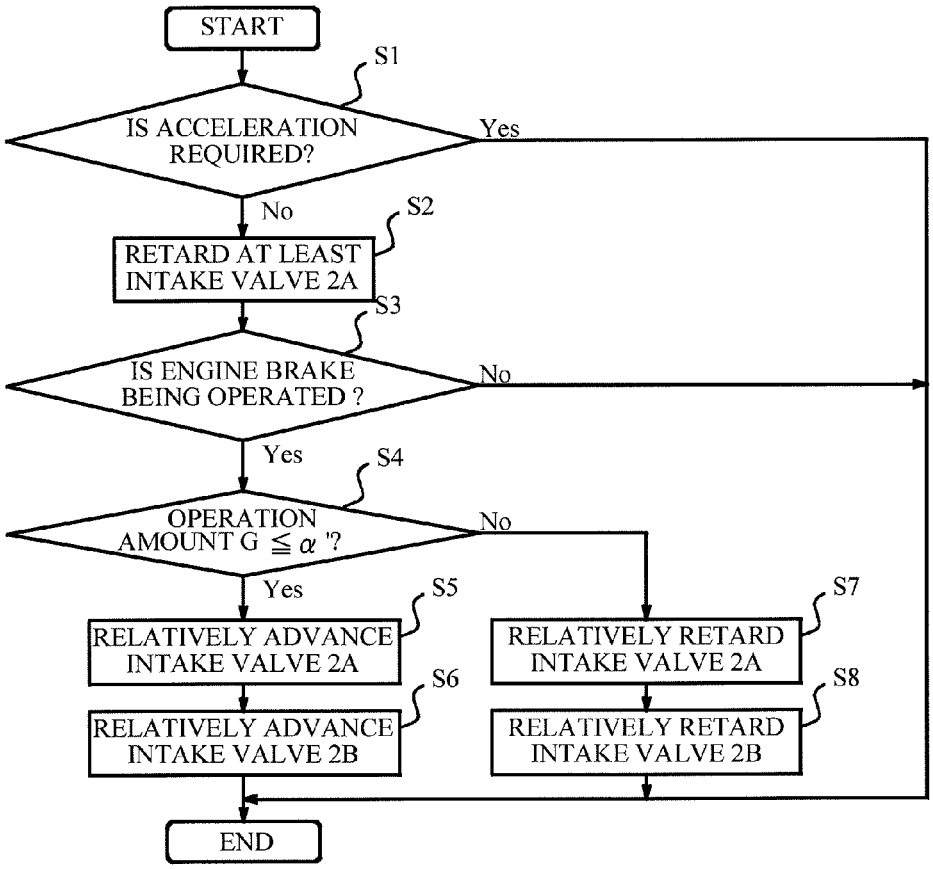
FIG. 5 is a flowchart of a first control operation.
Figure 6A:
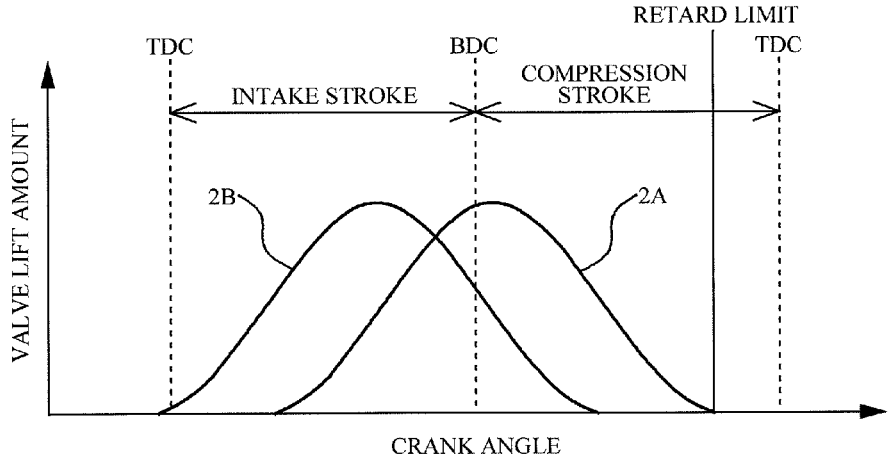
FIGS. 6A and 6B are views of phases of intake valves corresponding to FIG. 5.
Figure 6B:
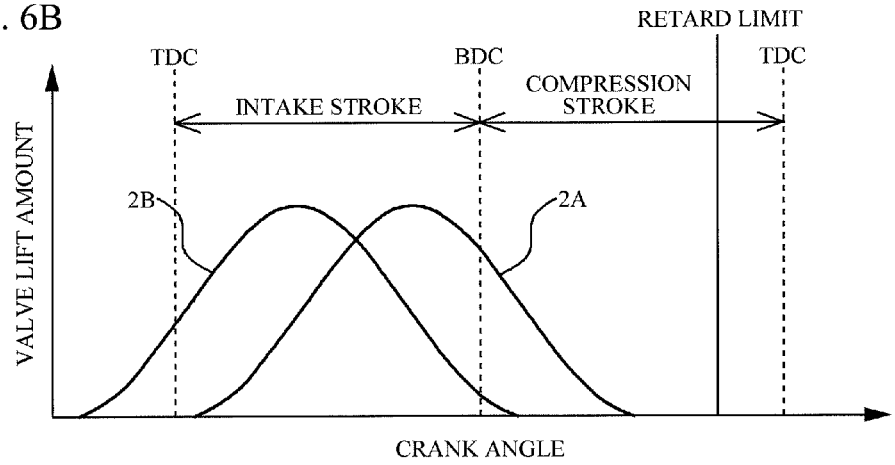

FIGS. 6A and 6B are views of the phases of the intake valves 2A and 2B corresponding to the flowchart illustrated in FIG. 5. FIG. 6A illustrates the phases of the intake valves 2A and 2B when the operation amount G is larger than the first predetermined value α'. FIG. 6B illustrates the phases of the intake valves 2A and 2B when the operation amount G is equal to or smaller than the first predetermined value α'. It can be seen from FIGS. 6A and 6B that the phases of the intake valves 2A and 2B are retarded in FIG. 6A more than in FIG. 6B. On the contrary, it can be seen that the phases of the intake valves 2A and 2B are advanced in FIG. 6B more than in FIG. 6A.

As illustrated in FIG. 6A, the ECU 70A retards the phase of the intake valve 2A, resulting in that the phase of the intake valve 2A is retarded at a maximum. This is because a torque reactive force is structurally applied to the outer camshaft 11 and the inner camshaft 12 during the engine brake operation.

Next, effects of the ECU 70A will be described. Herein, in the engine 1 equipped with the VVT 30, for example, the closing timing of the intake valve 2A, of the intake valves 2A and 2B, is retarded during the idle driving, and the engine 1 is performed in the high expansion ratio cycle such that the expansion ratio is larger than the actual compression ratio, whereby the fuel consumption can be improved. In this regard, for example, the closing timing of the intake valve 2A is beforehand retarded during the engine brake operation, and then the idle driving is shifted, thereby improving the fuel consumption. However, in this case, the actual engine brake might be excessive relative to the requirement engine brake.

Thus, the ECU 70A controls the VVT 30 based on the magnitude of the requirement engine brake so as to vary at least one of the phases of the intake valves 2A and 2B. For this reason, the ECU 70A can suitably control the magnitude of the engine brake.

When the magnitude of the requirement engine brake is smaller than the first predetermined value α, the ECU 70A advances at least one of the phases of the intake valves 2A and 2B, as compared with when the magnitude of the requirement engine brake is larger than the first predetermined value α.

In this regard, when the magnitude of the requirement engine brake is smaller than the first predetermined value α, the phase of the intake valve 2A is advanced, as compared with when the magnitude of the requirement engine brake is larger than the first predetermined value α. Therefore, the excessive expansion can be suppressed, when the magnitude of the requirement engine brake is relatively small. As a result, when the magnitude of the requirement engine brake is relatively small, the engine brake is controlled to be relatively small. This can suitably control the magnitude of the engine brake.

Also, when the magnitude of the requirement engine brake is smaller than the first predetermined value α, the phase of the intake valve 2B is advanced, as compared with when the magnitude of the requirement engine brake is larger than the first predetermined value α. Therefore, when the magnitude of the requirement engine brake is relatively small, the valve lift amount at the intake stroke start timing is made relatively large. As a result, when the magnitude of the requirement engine brake is relatively small, the engine brake is controlled to be relatively small. This can suitably control the magnitude of the engine brake.

In this regard, specifically, when the magnitude of the requirement engine brake is smaller than the first predetermined value α, the ECU 70A advances at least one of the phases of the intake valves 2A and 2B, as compared with when the phases of the intake valves 2A and 2B are not varied based on the magnitude of the requirement engine brake.

Thus, when the magnitude of the requirement engine brake is larger than the first predetermined value α, the ECU 70A retards at least the phase of the intake valve 2A such that the phase of the intake valve 2A is retarded relative to the phase of the intake valve 2B. Therefore, the closing timing of the intake valve 2A, of the intake valves 2A and 2B, can be retarded in preparation for the idle driving. Accordingly, when the idle driving is shifted, the fuel consumption can be early improved in a suitable manner.

When the magnitude of the requirement engine brake is smaller than the first predetermined value α, the ECU 70A advances the phases of the intake valves 2A and 2B. Therefore, when the magnitude of the requirement engine brake is larger than the first predetermined value α, the phases of the intake valves 2A and 2B are retarded, as compared with when the magnitude of the requirement engine brake is smaller than the first predetermined value α. Thus, when the magnitude of the engine brake is suitably controlled based on the magnitude of the requirement engine brake, the ECU 70A distinguishes a case where the magnitude of the requirement engine brake is relatively small from a case where that is relatively large, and then the magnitude of the engine brake can be quickly controlled to a large extent.

Figure 7:
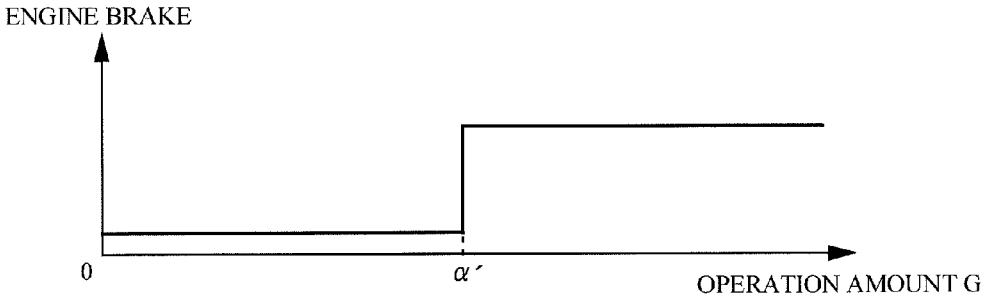
FIG. 7 is a view of engine brake in the first embodiment.
Figure 8A:
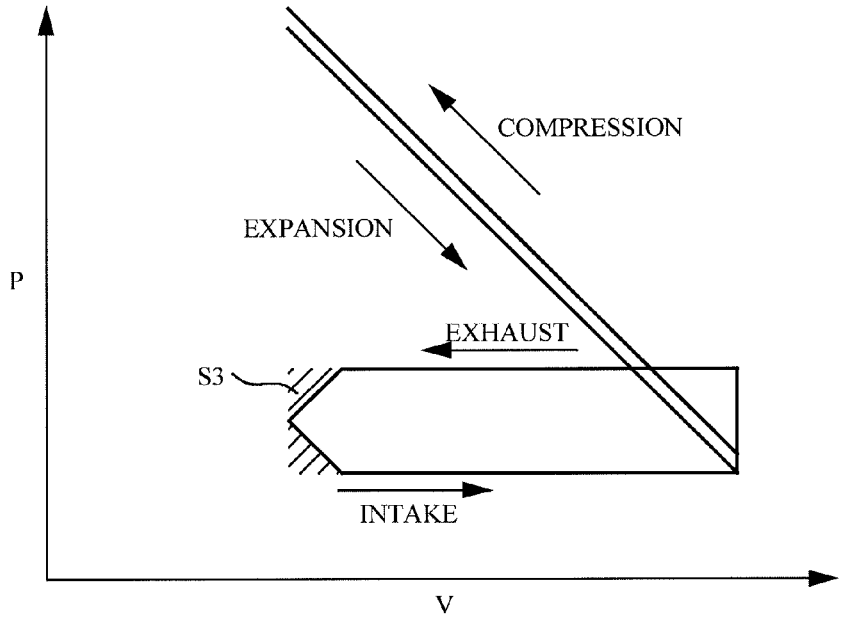
FIGS. 8A and 8B are PV diagrams during the engine brake operation in the first embodiment.
Figure 8B:
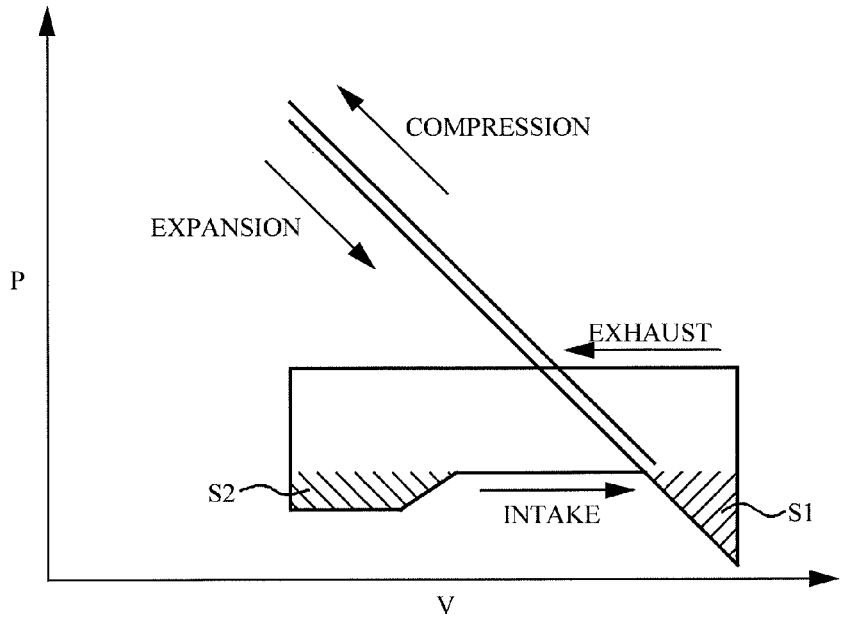

FIG. 7 is a view of the magnitude of the engine brake based on the operation amount G. FIGS. 8A and 8B are PV diagrams during the engine brake operation. FIG. 8A illustrates the PV diagram when the operation amount G is equal to or smaller than the first predetermined value α'. FIG. 8B illustrates the PV diagram when the operation amount G is larger than the first predetermined value α'. FIGS. 7, 8A, and 8B illustrate the magnitude of the engine brake and the PV diagrams in the engine 1 employing the ECU 70A.

When the operation amount G is equal to or smaller than the first predetermined value α' as illustrated in FIG. 7, the engine 1 causes the engine brake to be relatively small, as compared with when the operation amount G is larger than the first predetermined value α'. Also, when the operation amount G is larger than the first predetermined value α', the engine brake is caused to be relatively large, as compared with when the operation amount G is equal to or smaller than the first predetermined value α'. This suitably controls the magnitude of the engine brake.

Specifically, as illustrated in FIGS. 8A and 8B, an area surrounded by PV lines in FIG. 8A is smaller than that in the FIG. 8B by areas S1 and S2, in addition, and an area S3 is reduced by a reduction in pumping loss. In other words, the area surrounded by the PV lines in FIG. 8B is larger than that in FIG. 8A by the areas S1, S2, and S3.

The effects of the suppression of excessive expansion by advancing the intake valve 2A appear as a reduction in an area by the area S1. Also, a reduction in an area by the area S2 means effects of a reduction in the pumping loss by advancing at least the intake valve 2A of the intake valves 2A and 2B. Also, a reduction in an area by the area S3 means effects of a reduction in the pumping loss by advancing the intake valve 2B.

In the engine 1, an increase in the mechanical compression ratio caused by the variable compression ratio mechanism 5 greatly retards the closing timing of the intake valve 2A. For example, this can suitably improves the fuel consumption in the idle driving state. However, in this case, for example, in a case where the closing timing of the intake valve 2A is greatly retarded regardless of the magnitude of the requirement engine brake, the actual magnitude of the engine brake tends to be larger than the magnitude of the requirement engine brake, when the magnitude of the requirement engine brake is relatively small. Therefore, the ECU 70A is suitable for the engine 1 equipped with the variable compression ratio mechanism 5.

In the engine 1, the torque-reaction force is structurally applied to the outer camshaft 11 and the inner camshaft 12 during the engine brake operation. Thus, for example, when at least the phase of the intake valve 2A is retarded during the engine brake operation in preparation for the idle driving such that the phase of the intake valve 2A is retarded relative to the phase of the intake valve 2B, the phase of the intake valve 2A is retarded at a maximum. As a result, when the magnitude of the requirement engine brake is relatively small, the actual engine brake tends to be excessively larger than the requirement engine brake.

For this reason, in a case where the engine 1 is equipped with the dual camshaft 10 composed of the outer camshaft 11 and the inner camshaft 12, the VVT 30 is a valve drive device for varying at least one of the phases of the intake valves 2A and 2B by rotating at least one of the outer camshaft 11 and the inner camshaft 12, the ECU 70A is suitable to retard at least the phase of the intake valve 2A during the engine brake operation such that the phase of the intake valve 2A is retarded relative to the phase of the intake valve 2B. Additionally, the valve drive device in this case, for example, includes two phase control mechanisms as disclosed in Patent Document 1.

Further, in relation thereto, in the engine 1, the closing timing of the intake valve 2A is retarded for convenience in some cases unless the acceleration is required. However, in this case, the closing timing of the intake valve 2A is retarded when the acceleration is not required, so that the torque reaction force is applied to the outer camshaft 11 and the inner camshaft 12 during the engine brake operation. Therefore, the phase of the intake valve 2A is retarded at the maximum. Thus, specifically, in a case where at least the phase of the intake valve 2A is retarded when the acceleration is not required such that the phase of the intake valve 2A is retarded relative to the phase of the intake valve 2B, the ECU 70A is suitable.

In the engine 1, the opening timing of the intake valve 2B is set to the intake stroke start timing during the engine brake operation. It is thus easy to adapt the intake valve 2B to the driving state including the idle driving afterward. However, in this case, the valve lift amount at the intake stroke start timing is zero or extremely small. Thus, it is difficult to introduce the intake air into the cylinder, thereby increasing the pumping loss. As a result, when the magnitude of the requirement engine brake is relatively small, the actual engine brake tends to be excessively larger than the requirement engine brake.

Thus, in a case where the phase of the intake valve 2B is advanced when the magnitude of the requirement engine brake is smaller than the first predetermined value $\alpha$, as compared with when the magnitude of the requirement engine brake is larger than the first predetermined value $\alpha$, the ECU 70A is suitable to set the opening timing of the intake valve 2B to the intake stroke start timing when the magnitude of the requirement engine brake is larger than the first predetermined value $\alpha$.

When the acceleration is not required and then the fuel cut is performed in the engine 1, the ECU 70A controls the VVT 30 based on the requirement engine brake. In this regard, in a case where the fuel cut is performed in the engine 1 when the acceleration is not required, a relatively small degree of acceleration is stopped and then the engine brake works. Accordingly, the ECU 70A is suitable for the situation where the feeling of the engine brake increases.

Thus, in a case where the acceleration is not required to perform the fuel cut in the engine 1 so that the VVT 30 is controlled based on the requirement engine brake and a case where the fuel cut is performed when the acceleration is not required, the ECU 70A is suitable for such an engine.

The ECU 70A suitably controls the magnitude of the engine brake, specifically, the engine 1 is installed in a vehicle, whereby a driver is suppressed from being given the feel of the deceleration more than necessary. Also, the engine 1 is installed in the vehicle which regenerates the kinetic energy during the brake (for example, a hybrid vehicle), the efficiency is suppressed from reducing.

Second Embodiment

An ECU 70B as an engine controller in the present embodiment is substantially the same as the ECU 70A, except that the controller is achieved as follows. Thus, the illustration of the ECU 70B is omitted. The ECU 70B is associated with the engine 1 instead of the ECU 70A. When the magnitude of the requirement engine brake is smaller than the first predetermined value $\alpha$, the ECU 70B varies the phases of the intake valves 2A and 2B as follows, instead of advancing them.

That is, in the ECU 70B, the controller advances the phases of the intake valves 2A and 2B when the magnitude of the requirement engine brake is smaller than the first predetermined value $\alpha$, and the controller preferentially advances any one of the phases of the intake valves 2A and 2B when the magnitude of the requirement engine brake is becoming smaller than the first predetermined value $\alpha$. In this regard, the controller advances the phase of the intake valves 2A of the intake valves 2A and 2B.

Specifically, when the magnitude of the requirement engine brake is smaller than the second predetermined value $\beta$ smaller than the first predetermined value $\alpha$ (specifically, when the magnitude of the requirement engine brake is equal to or smaller than the second predetermined value $\beta$), the controller advances the phases of the intake valves 2A and 2B, as compared with when the magnitude of the requirement engine brake is larger than the first predetermined value $\alpha$. Also, when the magnitude of the requirement engine brake is larger than the second predetermined value $\beta$ and smaller than the first predetermined value $\alpha$, the phase of the intake valve 2A is advanced of the intake valves 2A and 2B, as compared with when the magnitude of the requirement engine brake is larger than the first predetermined value $\alpha$.

The second predetermined value $\beta$ may be included in a case where the magnitude of the requirement engine brake is larger than the second predetermined value $\beta$, and the controller may control a case where the magnitude of the requirement engine brake is smaller than the second predetermined value $\beta$ and a case where it is equal to or larger than the second predetermined value $\beta$.

Figure 9A:
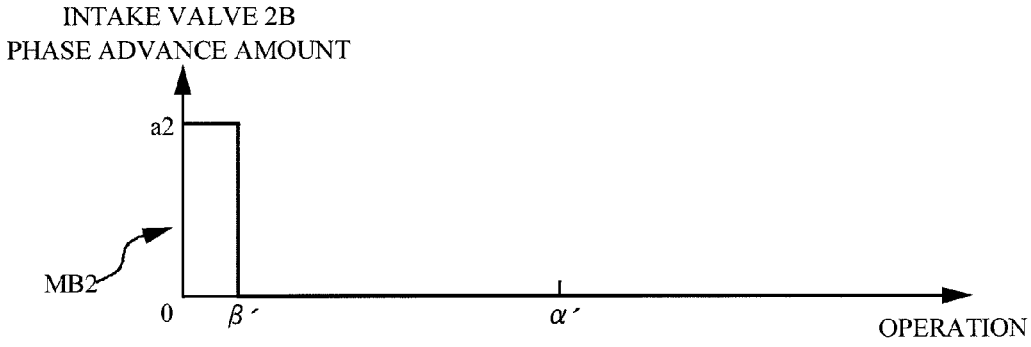
FIGS. 9A and 9B are schematic views of the phase advance amount map data in a second embodiment.
Figure 9B:
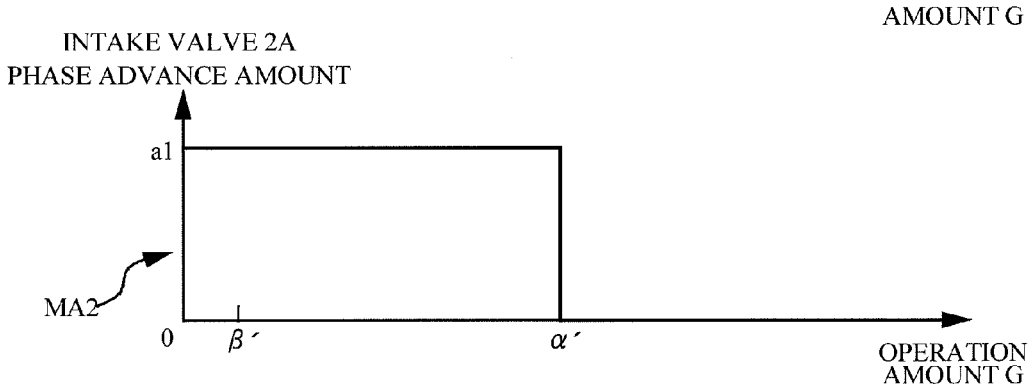

FIGS. 9A and 9B are schematic views of map data MA2 and MB2, stored in the ECU 70B, relating to phase advance amounts of the intake valves 2A and 2B. FIG. 9A illustrates the map data MB2 relating to the phase advance amount of the intake valve 2B, and FIG. 9B illustrates the map data MA2 relating to the phase advance amount of the intake valve 2A. The map data MA2 and MB2 are made, as a reference with the phase being varied when the magnitude of the requirement engine brake is larger than the first predetermined value α. A second predetermined value β' corresponds to the second predetermined value β in the requirement engine brake in the operation amount G. Additionally, the map data MA2 is the same as the map data MA1.

As illustrated in FIG. 9A, when the operation amount G is equal to or smaller than the second predetermined value β' (thus, when the operation amount G is smaller than the second predetermined value β'), the phase advance amount of the intake valve 2B is set to a predetermined valve α2. Also, when the operation amount G is larger than the second predetermined value β' and larger than the first predetermined value α', the phase advance amount of the intake valve 2B is set to zero. As illustrated in FIG. 9B, when the operation amount G is equal to or smaller than the second predetermined value r and equal to or smaller than the first predetermined value α', the phase advance amount of the intake valve 2A is set to the predetermined value α1. Also, when the operation amount G is larger than the first predetermined value α', the phase advance amount of the intake valve 2A is set to zero.

On the other hand, specifically, the controller detects the operation amount G, and then reads the corresponding phase advance amounts of the intake valves 2A and 2B with reference to the map data MA2 and MB2. Then, the VVT 30 is controlled such that the phase advance amounts of the intake valves 2A and 2B are set to the read phase advance amounts, thereby varying the phases of the intake valves 2A and 2B as mentioned above. In this regard, when the magnitude of the requirement engine brake is smaller than the first predetermined value α and smaller than the second predetermined value β, the controller advances the phase of the intake valve 2A such that the phase advance amount is set to the predetermined value α1. Also, when the requirement engine brake is smaller than the second predetermined value β, the phase of the intake valve 2B is advanced such that the phase advance amount is set to the predetermined value α2.

Figure 10:
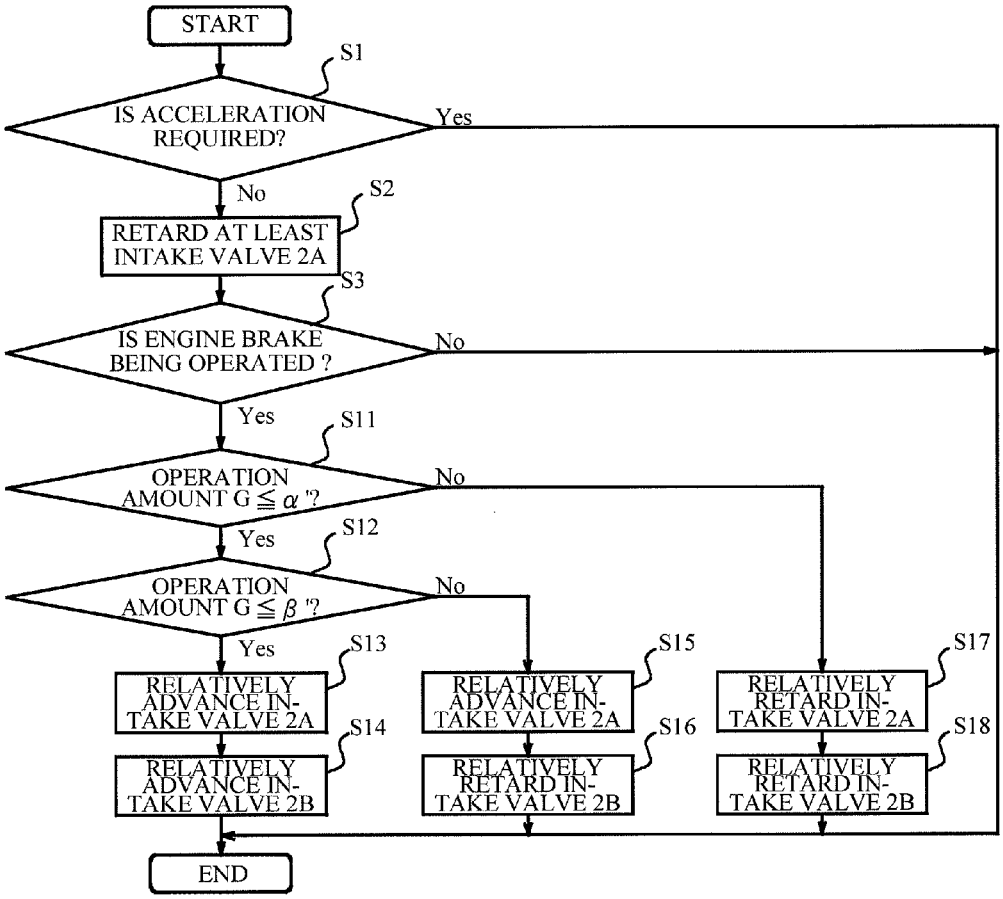
FIG. 10 is a flowchart of a second control operation.

Next, the second control operation of the ECU 70B will be described with reference to a flowchart illustrated in FIG. 10. Additionally, steps S1 to S3 and subsequent processes illustrated in FIG. 10 are the same as steps S1 to S3 in the flowchart illustrated in FIG. 5. Thus, these explanation is omitted. If a positive determination is made in step S3, the ECU 70B determines whether or not the operation amount G is equal to or smaller than the first predetermined value α' (step S11). Therefore, it is determined whether or not the magnitude of the requirement engine brake is smaller than the first predetermined value α.

If a positive determination is made in step S11, the ECU 70B determines whether or not the operation amount G is equal to or smaller than the second predetermined value β' (step S12). Therefore, it is determined whether or not the magnitude of the requirement engine brake is smaller than the second predetermined value β.

If a positive determination is made in step S12, the ECU 70B relatively advances the phase of the intake valve 2A, as compared with when the operation amount G is larger than the first predetermined value α' (step S13). Also, the phase of the intake valve 2B is advanced, as compared with when the operation amount G is larger than the first predetermined value α' (step S14). In steps S13 and S14, specifically, the phases of the intake valves 2A and 2B can be advanced as a reference with the phases of the intake valves 2A and 2B being varied when the operation amount G is larger than the first predetermined value α', (that is, when the magnitude of the requirement engine brake is larger than the first predetermined value α).

If a negative determination is made in step S12, the ECU 70B relatively advances the phase of the intake valve 2A, as compared with when the operation amount G is larger than the first predetermined value α' (step S15). Also, the phase of the intake valve 2B is relatively retarded, as compared with when the operation amount G is equal to or smaller than the first predetermined value β' (step S16). In steps S15 and S16, specifically, the phases of the intake valves 2A and 2B can be advanced and the phase of the intake valve 2B can be retarded relative to the phase of the intake valve 2A, on the basis of the phases of the intake valves 2A and 2B to be varied at the time when the operation amount G is larger than the first predetermined value α'. Further, at this time, the opening timing of the intake valve 2B can be set to the intake stroke start timing.

If a negative determination is made in step S11, the ECU 70B relatively retards the phase of the intake valve 2A, as compared with when the operation amount G is equal to or smaller than the first predetermined value α' (step S17). Also, the phase of the intake valve 2B is relatively retarded, as compared with when the operation amount G is equal to or smaller than the second predetermined value β' (step S18). In steps S17 and S18, specifically, the phase of the intake valve 2A at least continues being retarded from the time when the acceleration is not required.

Figure 11:
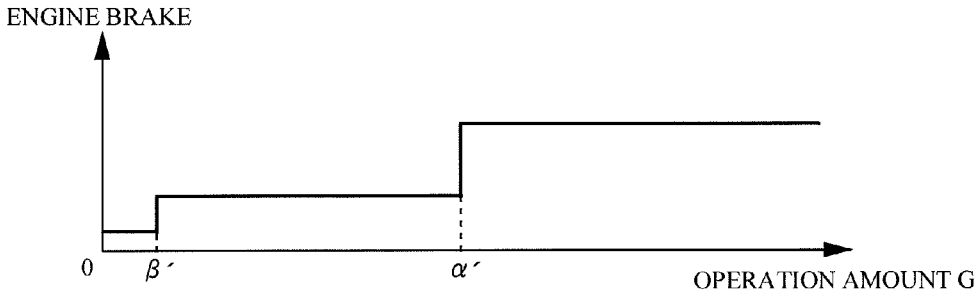
FIG. 11 is a view of the engine brake in the second embodiment.

Next, effects of the ECU 70B will be described. FIG. 11 is a view of the magnitude of the engine brake based on the operation amount G. FIG. 11 illustrates the magnitude of the engine brake of the engine 1 employing the ECU 70B. As illustrated in FIG. 11, when the operation amount G is equal to or smaller than the second predetermined value β', the engine 1 employing the ECU 70B causes the engine brake to be relatively small, as compared with when the operation amount G is larger than the second predetermined value β' and is equal to or smaller than the first predetermined value α'.

Also, when the operation amount G is larger than the second predetermined value β' and is equal to or smaller than the first predetermined value α', the engine brake is caused to be reduced, as compared with when the operation amount G is larger than the first predetermined value α'. Thus, the ECU 70B can gradually control the magnitude of the engine brake based on the magnitude of the requirement engine brake. In this regard, the ECU 70B can control the magnitude of the engine brake more suitably than the ECU 70A.

In this regard, the ECU 70B is suitable to gradually control the magnitude of the engine brake as follows. Herein, the intake valve 2A that operates late when there is a phase difference between the intake valves 2A and 2B, and the intake valve 2A more influences the strength of the engine brake than the intake valve 2B when the closing timing of the intake valve 2A is retarded.

Thus, the ECU 70B advances the phases of the intake valves 2A and 2B when the magnitude of the requirement engine brake is smaller than the first predetermined value α, and the ECU 70B preferentially advances the phase of the intake valve 2A of the intake valves 2A and 2B, when the magnitude of the requirement engine brake is becoming smaller than the first predetermined value α.

Thus, when the operation amount is reduced after the brake pedal 91 is greatly operated in a moment, the ECU 70B preferentially allows the engine brake to be small to a large extent. Thus, in a case where, for example, the engine 1 is installed in the vehicle regenerating the kinetic energy during the brake operation, the ECU 70B is suitably suppress a reduction in the regeneration efficiency and is suitable to gradually control the magnitude of the engine brake.

In contrast, when the operation amount of the brake pedal 91 is large after being small, the ECU 70B preferentially retards the phase of the intake valve 2B which relatively less influences the engine brake than the intake valve 2A. Also, when the operation amount is small after being large, the phase of the intake valve 2B of the intake valves 2A and 2B is advanced.

In this regard, for example, the brake operation is to finely adjust a vehicle speed in a case where the engine 1 is installed in the vehicle. Thus, for example, in a case where the engine 1 is installed in the vehicle, the ECU 70B is suitable to suppress a driver from feeling uncomfortable and suitably control the engine brake in a gradual manner.

Third Embodiment

An ECU 70C as the engine controller according to the present invention is substantially the same as the ECU 70B, except that the phase advance amounts of the intake valves 2A and 2B are set as follows and in response to this the controller is achieved as follows. Thus, the illustration of the ECU 70C is omitted. The ECU 70C is associated with the engine 1 instead of the ECU 70A.

Figure 12A:
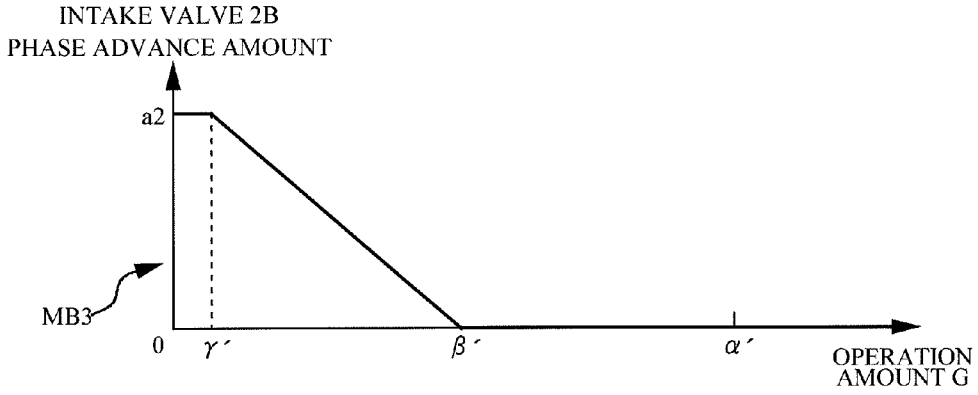
FIGS. 12A and 12B are schematic view of the phase advance amount map data in a third embodiment.
Figure 12B:
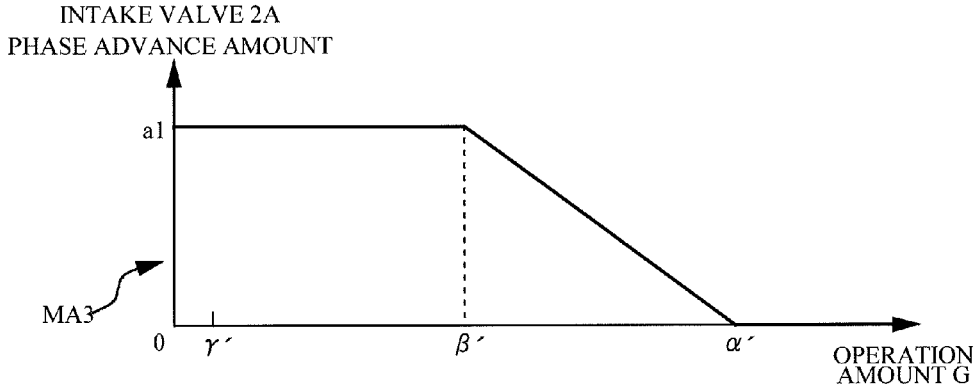

FIGS. 12A and 12B are schematic views of map data MA3 and MB3, stored in the ECU 70C, relating to phase advance amounts of the intake valves 2A and 2B. Specifically, FIG. 12A illustrates the map data MB3 relating to the phase advance amount of the intake valve 2B, and FIG. 12B illustrates the map data MA3 relating to the phase advance amount of the intake valve 2A. The map data MA3 and MB3 are made, as a reference with the phase being varied when the magnitude of the requirement engine brake is larger than the first predetermined value α.

As illustrated in FIG. 12A, when the operation amount G is equal to or smaller than the first predetermined value β', the phase advance amount of the intake valve 2B is set as follows. That is, when the operation amount G is equal to or smaller than a third predetermined value γ' smaller than the second predetermined value β' (thus, when the operation amount G is smaller than the third predetermined value γ'), the predetermined value α2 is set. Also, when the operation amount G is larger than the third predetermined value γ' and is equal to or smaller than the second predetermined value β', the phase advance amount is larger as the operation amount G is smaller in such a manner that the phase advance amount finally arrives at the predetermined value α2. When the operation amount G is larger than the second predetermined value β' and lager than the first predetermined value α', zero is set. The third predetermined value γ' may be zero.

As illustrated in FIG. 12B, when the operation amount G is equal to or smaller than the second predetermined value β', the phase advance amount of the intake valve 2A is set to the predetermined value α1. Also, when the operation amount G is larger than the second predetermined value β' and is equal to or smaller than the first predetermined value α', the phase advance amount is larger as the operation amount G is smaller in such a manner that the phase advance amount finally arrives at the predetermined value α1. When the operation amount G is larger than the first predetermined value α', zero is set.

In response to this, the ECU 70C is achieved as follows. That is, when the magnitude of the requirement engine brake is larger than the second predetermined value β and smaller than the first predetermined value α, the phase of the intake valve 2A is advanced to a larger extent as the magnitude of the requirement engine brake is smaller. Therefore, the phase of the intake valve 2A is advanced to a larger extent as the magnitude of the requirement engine brake is at least partially smaller.

Also, when the magnitude of the requirement engine brake is smaller than the second predetermined value β, the phase of the intake valve 2A is advanced such that its phase advance amount is the predetermined value α1. On the other hand, the controller advances the phase of the intake valve 2B as follows.

That is, when the magnitude of the requirement engine brake is smaller than the third predetermined value γ corresponding to the third predetermined value γ' (specifically, when the magnitude of the requirement engine brake is equal to or smaller than the third predetermined value γ), the phase of the intake valve 2B is advanced such that its phase advance amount is the predetermined value α2. Also, the magnitude of the requirement engine brake is larger than the third predetermined value γ and smaller than the second predetermined value β, the phase of the intake valve 2B is advanced to a larger extent as the magnitude of the requirement engine brake is smaller. Therefore, the phase of the intake valve 2B is advanced to a larger extent as the magnitude of the requirement engine brake is at least partially smaller.

In this regard, when the magnitude of the requirement engine brake is larger than the second predetermined value β and smaller than the first predetermined value α, the phase of the intake valve 2A is advanced to a larger extent as the magnitude of the requirement engine brake is smaller in such a manner that the phase advance amount finally arrives at the predetermined value α1. Also, when the magnitude of the requirement engine brake is larger than the third predetermined value γ and smaller than the second predetermined value β, the phase of the intake valve 2B is advanced to a lager extent as the magnitude of the requirement engine brake is smaller in such a manner that the phase advance amount finally arrives at the predetermined value α2.

The third predetermined value γ may be included in a case where the magnitude of the requirement engine brake is larger, and the controller may control a case where the magnitude of the requirement engine brake is smaller than the third predetermined value γ and a case where the magnitude of the requirement engine brake is equal to or larger than the third predetermined value γ.

Figure 13:
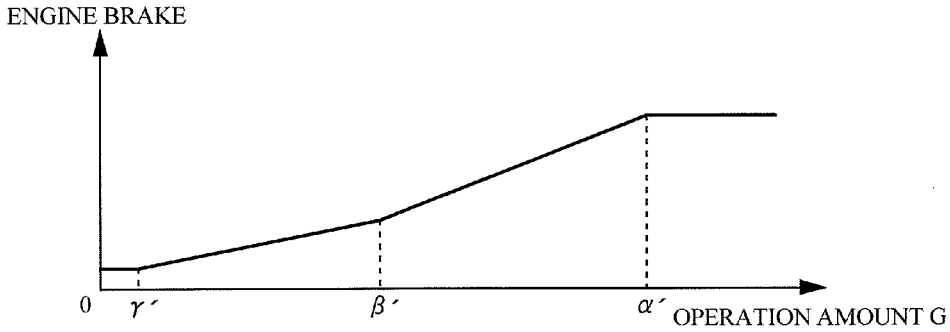
FIG. 13 is a view of the engine brake in the third embodiment.
Figure 14:
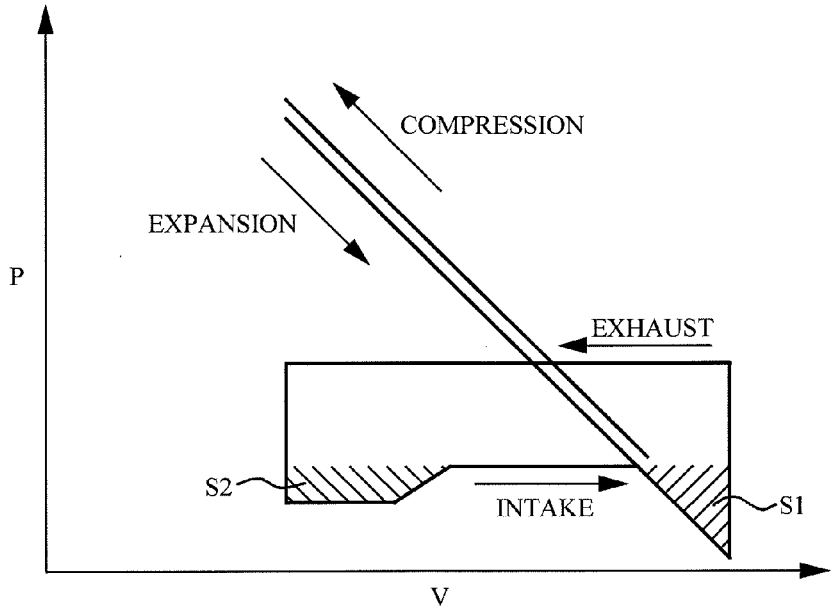
FIG. 14 is an exemplary view of a PV diagram during the engine brake operation.
Figure 15:
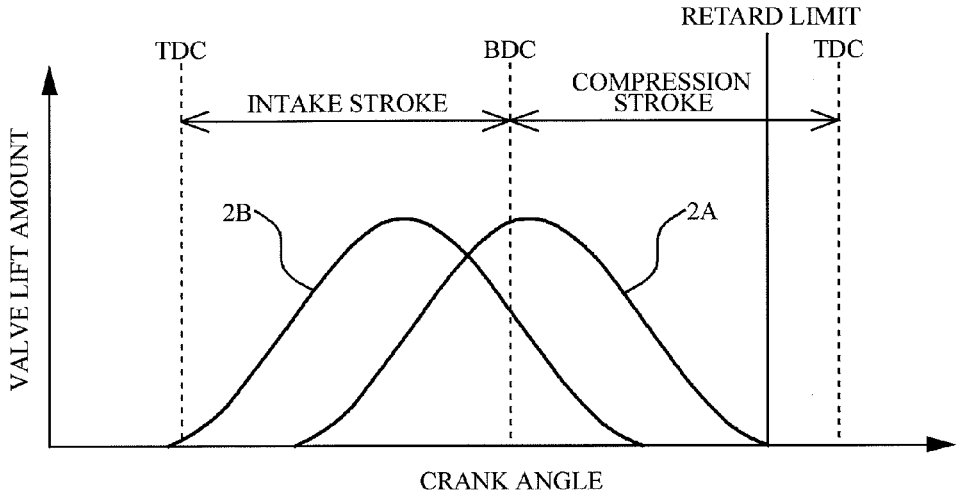
FIG. 15 is a view of a phase of the intake valve corresponding to FIG. 14.

Next, effects of the ECU 70C will be described. FIG. 13 is a view of the magnitude of the engine brake based on the operation amount G. FIG. 13 illustrates the magnitude of the engine brake of the engine 1 employing the ECU 70C. As illustrated in FIG. 13, when the operation amount G is larger than the second predetermined value β' and is equal to or smaller than the first predetermined value α', the engine 1 employing the ECU 70C causes the engine brake to be smaller as the operation amount G is smaller. Also, when the operation amount G is larger than the third predetermined value γ' and is equal to or smaller than the second predetermined value β', the engine brake is caused to be smaller as the operation amount G is smaller.

That is, the magnitude of the requirement engine brake is larger than the second predetermined value β and smaller than the first predetermined value α (that is, at least partially), the ECU 70C advances the phase of the intake valve 2A to a larger extent as the magnitude of the requirement engine brake is smaller. Therefore, the strength of the engine brake can be made to follow at least partially the magnitude of the requirement engine brake continuously. Accordingly, the magnitude of the engine brake can be more suitably controlled than the ECU 70B.

Also, when the magnitude of the requirement engine brake is larger than the third predetermined value γ and smaller than the second predetermined value β (that is, at least partially), the ECU 70C advances the phase of the intake valve 2B to a larger extent as the magnitude of the requirement engine brake is smaller. Therefore, the strength of the engine brake can be made to follow at least partially the magnitude of the requirement engine brake continuously. Accordingly, the magnitude of the engine brake can be more suitably controlled than the ECU 70B.

When the magnitude of the requirement engine brake is smaller than the second predetermined value β, the ECU 70C advances the phase of the intake valve 2A such that its phase advance amount is the predetermined value α1. When the magnitude of the requirement engine brake is larger than the second predetermined value β and smaller than the first predetermined value α, the ECU 70C advances the phase of the intake valve 2A to a larger extent as the magnitude of the requirement engine brake is smaller in such a manner that the phase advance amount finally arrives at the predetermined value α1. Also, when the magnitude of the requirement engine brake is smaller than the third predetermined value γ, the phase of the intake valve 2B is advanced such that its phase advance amount is the predetermined value α2. When the magnitude of the requirement engine brake is larger than the third predetermined value γ and smaller than the second predetermined value β, the phase of the intake valve 2B is advanced to a lager extent as the magnitude of the requirement engine brake is smaller in such a manner that the phase advance amount finally arrives at the predetermined value α2.

That is, specifically, the ECU 70C varies the phases of the intake valves 2A and 2B in such a way. Therefore, the magnitude of the engine brake can be more suitably controlled than the ECU 70B in consideration of the difference of the influence on the strength of the engine brake, like the ECU 70B. Further, in this case, it can be seen from the magnitude of the engine brake illustrated in FIG. 13 that the torque shock occurring in the engine 1 is prevented based on a change in the operation amount G (a change in the magnitude of the requirement engine brake) in consideration of the difference of the influence on the strength of the engine brake.

Additionally, in order to prevent the torque shock in the engine 1, for example, when the magnitude of the requirement engine brake is smaller than the first predetermined value α, until the magnitude of the requirement engine brake is zero, the phases of the intake valves 2A and 2B can be advanced to a larger extent as the requirement engine brake is smaller. Thus, the ECU 70C is suitable to prevent the torque shock from occurring in the engine 1, and to control the magnitude of the engine brake in consideration of the difference of the influence on the strength of the engine brake.

While the exemplary embodiments of the present invention have been illustrated in detail, the present invention is not limited to the above-mentioned embodiments, and other embodiments, variations and modifications may be made without departing from the scope of the present invention.

DESCRIPTION OF LETTERS OR NUMERALS engine 1
intake valve 2, 2A, 2B
variable compression ratio mechanism 5
first camshaft 10
outer camshaft 11
inner camshaft 12
VVT 30
ECU 70A, 70B, 70C

The invention claimed is:

1. An engine control apparatus provided in an engine provided with a valve drive device capable of independently setting a phase of one intake valve and a phase of another intake valve of plural intake valves mounted for a combustion chamber, the engine control apparatus comprising:

a controller controlling the valve drive device based on a magnitude of engine brake required to the engine to vary at least one of the phase of the one intake valve and the phase of the another intake valve, wherein, when the magnitude of the engine brake required to the engine is smaller than a first predetermined value, the controller advances the phase of the one intake valve and the phase of the another intake valve, as compared with when the magnitude of the engine brake required to the engine is larger than the first predetermined value, and when the magnitude of the engine brake required to the engine is larger than the first predetermined value, the controller retards the phase of the one intake valve and the phase of the another intake valve, as compared with when the magnitude of the engine brake required to the engine is smaller than the first predetermined value.

2. An engine control apparatus provided in an engine provided with a valve drive device capable of independently setting a phase of one intake valve and a phase of another intake valve of plural intake valves mounted for a combustion chamber, the engine control apparatus comprising:

a controller controlling the valve drive device based on a magnitude of engine brake required to the engine to vary at least one of the phase of the one intake valve and the phase of the another intake valve, wherein, when the magnitude of the engine brake required to the engine is smaller than the first predetermined value, the controller advances the phase of the one intake valve and the phase of the another intake valve, as compared with when the magnitude of the engine brake required to the engine is larger than the first predetermined value, when the magnitude of the engine brake required to the engine is becoming smaller than the first predetermined value, the controller advances the phase of the one intake valve preferentially to the phase of the another intake valve, and when there is a phase difference between the one intake valve and the another intake valve, the one intake valve operates after the another intake valve operates.

3. The engine control apparatus of claim 2, wherein:

when the magnitude of the engine brake required to the engine is smaller than a second predetermined value smaller than the first predetermined value, the controller advances the phases of the one intake valve and the another intake valve, as compared with when the magnitude of the engine brake required to the engine is larger than the first predetermined value, and when the magnitude of the engine brake required to the engine is larger than the second predetermined value and smaller than the first predetermined value, the controller advances the phase of the one intake valve of the one intake valve and the another intake valve, as compared with when the magnitude of the engine brake required to the engine is larger than the first predetermined value.

4. The engine control apparatus of claim 3, wherein when the magnitude of the engine brake required to the engine is smaller than the second predetermined value, the controller advances the phase of the one intake valve such that a phase advance amount is a first phase advance amount, when the magnitude of the engine brake required to the engine is larger than the second predetermined value and smaller than the first predetermined value, the controller advances the phase of the one intake valve to a larger extent as the magnitude of the engine brake required to the engine is smaller and a phase advance amount to be reached is set as the first phase advance amount;

when the magnitude of the engine brake required to the engine is smaller than a third predetermined value smaller than the second predetermined value, the controller advances the phase of the another intake valve such that a phase advance amount is a second phase advance amount, and when the magnitude of the engine brake required to the engine is larger than the third predetermined value and smaller than the second predetermined value, the controller advances the phase of the another intake valve to a larger extent as the magnitude of the engine brake required to the engine is smaller and a phase advance amount to be reached is set as the second phase advance amount.

5. The engine control apparatus of claim 1, wherein the engine is provided with a variable compression ration mechanism for varying a mechanical compression ratio.

* * * * *